US006694563B2

(12) United States Patent
Onwugbonu

(10) Patent No.: US 6,694,563 B2
(45) Date of Patent: Feb. 24, 2004

(54) SOFT, SOOTHING BATH SCRUB

(76) Inventor: Reuben Onwugbonu, 64 Bruen Ave., Apt. 4, Irvington, NJ (US) 07111

( * ) Notice: Subject to any disclaimer, the term of this patent is extended or adjusted under 35 U.S.C. 154(b) by 115 days.

(21) Appl. No.: 09/825,686

(22) Filed: Apr. 4, 2001

(65) Prior Publication Data

US 2002/0144368 A1 Oct. 10, 2002

(51) Int. Cl.[7] ..... A47K 7/03; A47L 13/17

(52) U.S. Cl. ..... 15/244.3; 15/208; 15/209.1; 15/222; 15/229.11; 15/118

(58) Field of Search ..... 15/118, 208, 209.1, 15/222, 244.3, 244.1, 229.11

(56) References Cited

U.S. PATENT DOCUMENTS 1,379,925 A * 5/1921 Kawasaki ..... 15/222
4,457,640 A * 7/1984 Anderson ..... 401/7
4,510,641 A * 4/1985 Morris ..... 15/118
5,671,498 A * 9/1997 Martin et al. ..... 15/244.3
6,026,531 A * 2/2000 Pruitt ..... 15/160
D457,698 S * 5/2002 Susani ..... D32/40
6,485,822 B1 * 11/2002 Osiecki et al. ..... 428/316.6
6,510,577 B1 * 1/2003 Borcherds et al. ..... 15/118

* cited by examiner

*Primary Examiner*—Robert J. Warden, Sr.
*Assistant Examiner*—Shay L Balsis

(57) ABSTRACT

A soft soothing bath scrub is formed of a scrubbing layer, such as a a sponge layer, and a wash cloth layer. A stabilizing layer may be interposed, preferably by first attaching it to the underside of the sponge layer, and attaching the sponge layer to the wash cloth layer by intermittent fastening such as by stitches, through the wash cloth layer and into side edge of the sponge layer.

13 Claims, 3 Drawing Sheets

FIG. 3
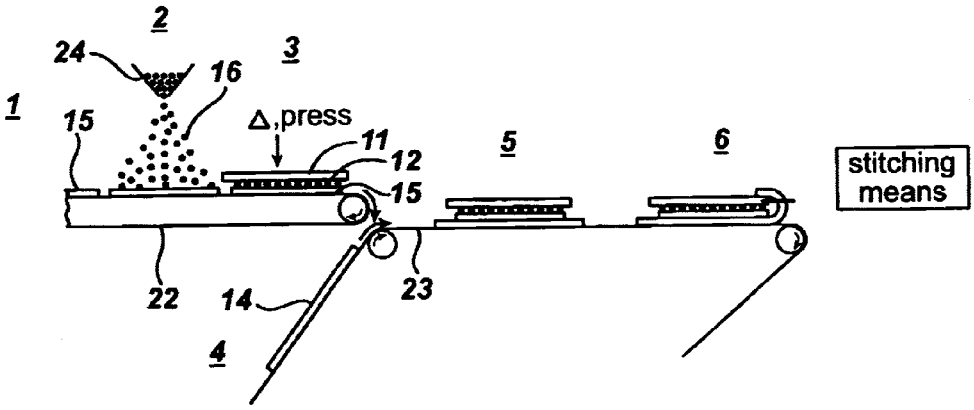
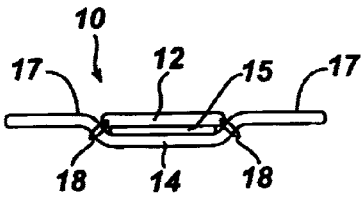
FIG. 3A
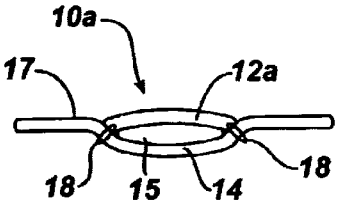
FIG. 3B

SOFT, SOOTHING BATH SCRUB

FIELD OF THE INVENTION

The present invention relates to wash cloths and scrubbing devices used to clean the human body. More specifically the present invention relates to combination wash cloths and scrubs.

BACKGROUND OF THE INVENTION

There are three basic bathing implements; the wash cloth, the scrub, such as a loffa sponge, and a brush. Different cultures are accustomed to different tools for the bath. In addition, certain health/medicine regimens, such as the Kushi anti-cancer program, suggest scrubbing the skin 2 times a day to enhance the circulation at the skin level and to promote the excretory function of the skin. Scrubbing bath tools, however, typically have no water capacity, requiring separate scrubbing and rinsing steps.

There have been many attempts to combine wash cloths with scrubs, or loofa sponges. One such example is the commercial product comprising a bath mitt with a sponge attached to one side of a fabric pocket. The thin fabric pocket of the product presents no equivalent to the softness and water absorbing, carrying or releasing capacity of a wash cloth. the edge of the loofa is covered by a binder strip which is sewn to the loofa, about the edge of the fabric pocket.

The comfort and utility of a wash cloth arises from its soft surface, its pliability, and its ability to transport water. Specifically, a wash cloth is expected to absorb and carry water and release it easily at the desired location. This water transportation ability not only assists the cleaning qualities of a wash cloth, but adds to the comfort of the user by providing water, and warmth, to the body. The washcloth, however, has limited scrubbing ability.

Recently, soft balls of nylon mesh have been promoted as a soft bath scrub. Though soft, these scrubs lack the softness of a wash cloth, and are completely lacking in water absorbency. Natural loofa sponges also lack the water absorbency of wash cloths. Artificial loofa sponges are said to have enhanced water absorbency but it is believed to be at the expense of softness.

Man-made closed cell foam sponges, are too soft to provide a scrubbing ability. More recently, fibrous composites have been constructed to simulate natural sponges. One has terry-like tufts projecting through a scrim, to resemble a loffa. Another is a bonded high loft matt of thermoplastic fibers. These man-made sponges also lack the water absorbency and release of a good wash cloth.

BRIEF DESCRIPTION OF THE DRAWINGS

FIG. 3 is a schematic diagram of a method of manufacturing a soft, soothing scrub according the present invention.

FIG. 3A is a cross-sectional view of the scrub of the present invention, when dry.

FIG. 3B is a cross-sectional view of the scrub of FIG. 3A, wet, with the loofa expanded.

SUMMARY OF THE INVENTION

The present invention comprises a soothing bath scrub, which retains the softness of a wash cloth, and provides a soft scrubbing surface. Bath scrubbing implements lack the water absorption and release of a wash cloth. Hence, one must rinse after scrubbing. In addition, the scrub does not easily soap and suds. The new soft netting balls do retain suds or foam, but not as well as a wash cloth They are completely lacking in water absorption.

The soft soothing bath scrub of the present invention comprises three layers; a stabilizing layer being interposed between the wash cloth and the scrubbing layer, typically a natural sponge. The stabilizing layer may be made of foam, netting or a non-slipping fabric layer, such as a napped fabric.

In another embodiment of the present invention, the stabilizing layer is omitted. In both embodiments, the fastening of the sponge to the wash cloth must be made into the side edge of the sponge, so as place the wash cloth about the edge of the sponge. In another embodiment the scrubbing layer is tapered at the edges and the wash cloth layer wrapped about the tapered edge and sewn thereto. The purpose of both constructions is to present a smooth uninterrupted surface for bathing.

It has been found advantageous to dampen the sponge to give it flexibility, before fastening it to the wash cloth. In another preferred embodiment, the sponge is pre-treated, as with bleach, to soften it and remove any coating on the sponge, and to leave the sponge a cream color. In another preferred embodiment, the sponge layer is given a slight hourglass shape, to make it easily graspable. If desired, the wash cloth layer may have the length of a bath towel, so that it may be wrapped about the back of the bather to scrub the back.

In constructing the preferred embodiment of the soothing bath scrub of the present invention it has been found advantageous to first fasten the stabilizing layer to the inner surface of the scrubbing layer. It is important not to stiffen the scrubbing layer when fastening it to the foam layer. Intermittent areas of binder, or adhesive, may be used and preferably flexible adhesive, such as drops of rubber sap. Alternatively particulate thermoplastic binder material, in granular or fiber form, may be placed on either the foam layer or the back of the scrubbing layer, and, binder cured, to create an overall fastening of the surfaces.

DETAILED DESCRIPTION OF THE INVENTION

Figure 1:
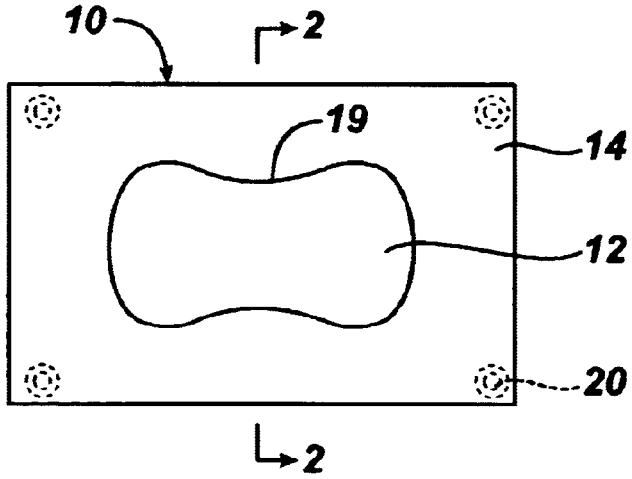
FIG. 1 is a top plan view of the washing surface of the soft, soothing, scrub of the present invention.
Figure 2:
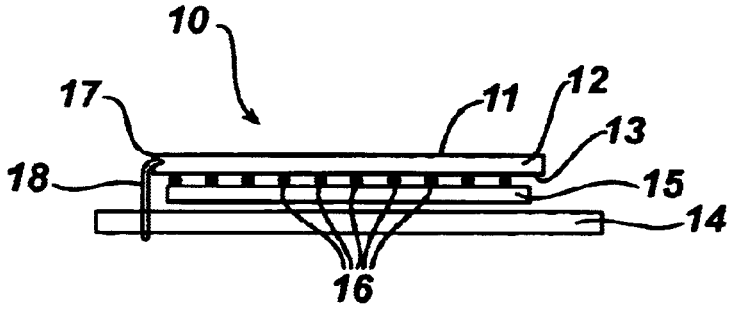
FIG. 2 is a cross-sectional view of the scrub of FIG. 1, taken a long line 2—2, shown schematically to illustrate the layered construction.

As shown in FIGS. 1 and 2, the preferred embodiment of the soothing bath scrub of the present invention, shown generally at 10, is constructed of a number of layers; fastened together in a unique manner to produce a unique bath scrub. As shown, a scrubbing layer, typically a natural sponge layer, is placed atop a wash cloth layer. When fully constructed only the outer surface, 11, of the scrubbing layer, 12, and the wash cloth layer, 14, are visible. The stabilizing layer, in this embodiment a foam layer, 15, adds to the water and soap retaining abilities of the wash cloth layer and make it easier to assemble the scrubbing layer to the wash cloth layer. The specific fastening technique is necessary to produce a soothing bath scrub having an interrupted scrubbing and washing surface.

In constructing the bath scrub of the present invention, the stabilizing layer, 15, is first fastened to the inner surface, 13, of the scrubbing layer, 12. As shown in FIGS. 1 & 2, the stabilizing foam layer, 15, has a slightly smaller area and dimensions than the scrubbing layer, 12. The size of the stabilizing layer is limited by the size of the of the scrubbing layer and the method of attachment of the wash cloth layer to the scrubbing layer. What is important is that the finished product presents no edge of the stabilizing layer at the transition between the scrubbing portion and the wash cloth portion. An edge of even a soft fabric at this position will produce a scrubbing ridge which will make the scrub uncomfortable to use.

The overall fastening of the scrubbing layer, 12, to the stabilizing foam layer, 13, is created with only intermittent adhesive, 16, forming intermittent fastening areas which extend along the surface of the stabilizing foam layer. In forming the soothing bath scrub of the present invention it has been found advantageous to apply binder material intermittently, as at 16, to the stabilizing foam layer, bring the scrubbing layer in contact with the binder material, and applying heat and pressure to form the intermittent adhesive fastening areas.

The intermittent adhesive fastening areas may be made in a number of ways. Drops of heated rubber sap may be applied to the foam, and the inner surface of the scrubbing layer placed over the rubber droplets. The rubber may then be cured at room temperature. The rubber set up is a soft flexible adhesive, and provides an ideal adhesive attachment of the foam layer to scrubbing layer. Alternatively, particles or fibers of thermoplastic material may be disposed across the surface of the foam layer, the scrubbing layer brought in contact with the thermoplastic material, and heat apply to bind the scrubbing layer to the foam layer. Other forms of binder material and binder application may be used, so long as the foam layer is attached to the scrubbing layer continuously along its inner surface, and the method of attachment does not substantially stiffen the scrubbing layer.

In a preferred embodiment of the present invention the scrubbing layer is made of natural sponge, however other scrubbing layers such as cosmetic puffs of thermoplastic fibers, or man-made composites meant to resemble natural sponges may also be used. When using a natural sponge material for the sponge layer, it is preferred that the natural sponge material be chemically treated to remove any coating on the sponge, and to soften and lighten the color of the sponge. For example, household bleach may be used to treat the natural sponge material, leaving it softer and a beautiful cream color. Depending on the coating on the sponge, various chemicals may be used to remove the coating. Generally, the sponge material must be rinsed to remove any residual chemicals.

To produce the soft, soothing scrub having a smooth uninterrupted surface, especially with a natural sponge, it is necessary to keep the sponge layer thin. Typically, only the small pore size at the outer surface of a loofa is used to make the best bath scrubs. This portion of the loofa also has smaller fibers and is generally smoother than the inside of the loofa. As loofas are not particularly easy to handle in a manufacturing process, a stabilizing layer may be used. It also reinforces the loofa, preventing its disintegration upon wetting, or continued use. In the most preferred embodiment, the stabilizing Layer is a layer of foam. The foam layer is intermittently fastened to the scrubbing (sponge) layer. When the stabilizing layer is a foam layer, the entire scrub product is soft, and very absorbent. When fully constructed, the foam is hidden, and the sponge seems to take on a softness and loft greater than that of the wash cloth layer.

In another embodiment, a layer, or multiple layers of netting may be used as the stabilizing layer. This stabilizing layer also adds loft, and thereby a fluid reservoir, though the netting material itself is not absorbent. The fluid reservoir of the foam or the netting serves as a reservoir for soap, permitting the bather to load the scrubber with soap, if desired, less often than with a simple sponge or simple wash cloth.

The soft soothing bath scrub of the present invention will retain its softness and integrity through many wash cycles in a. washing machine. Over a period of time, and many washings, artificial scrubbing layer materials such as cosmetic butts may suffer pilling at the outer surface. While this does not affect the integrity of the scrubbing layer, it negatively affect the comfortable, and soothing feel, of the scrub. Hence, when using a man-made scrubbing layer it may be necessary to tie down the surface fibers, such as by heat treatment, or the use of a binder material at the surface. This problem is rarely found when using natural sponges, as minute portions of the sponge at the outer surface tend to flake off during years of subsequent washings, leaving a fresh surface.

To attach the scrubbing layer to the wash cloth layer a series of intermittent fastenings, 18, such as stitches, are made between the wash cloth and the side edge, 17, of the scrubbing layer. Other fastenings, such as soft plastic loops or staples may be used, but it is important that the intermittent fastenings do not encroaching upon the outer surface, 11, of the scrubbing layer. Preferrably, the intermittent fastenings, 18, do not pass through, but extend about the foam layer, 15, so as to avoid a rigid line which can be created by many layers in a line of stitching. In this manner, the scrubbing layer and wash cloths layer create a soft soothing scrub.

Before creating the soft soothing bath scrub of the present invention various other methods of attachment were attempted. When the scrubbing layer was sewn to the wash cloth by a line of stitches at a small distance from the perimeter of the scrubbing layer, the stitching created a tough, stiffened portion in the scrubbing layer, which was uncomfortable.

The interposed foam layer seats well against the wash cloth layer (it stays where it is put). Seating well against the wash cloth layer is a requirement of the stabilizing layer. The foam layer, by attachment to the inner surface of the scrubbing layer, helps maintain the shape and stability of the scrubbing layer. Combining a wash cloth layer with a water expanding sponge layer was a difficult feat. When natural sponges are sliced thin enough to be incorporated into a soothing scrub, it may require reinforcement and stabilizing. Not only does the foam stabilize the scrubbing layer together, in addition it provides a loft, and a sense of softness and thickness to the scrubbing layer. The foam layer also imparts absorbency and water carrying ability to the scrub, as described above. Thus, a multi-layer, multifunction bath scrub is obtained having greater softness and water carrying ability than a wash cloth, and the scrubbing ability of a loofa. When fastened together as in the present invention, the scrubbing layer seems to melt into the wash cloth layer. In its most preferred form the scrubbing layer has an hourglass shape, 19, allowing the user to grasp the sponge (and the attached wash cloth) about the "waist" of the hourglass.

As shown in FIG. 2, the scrubbing layer 12, is generally smaller than the wash cloth. In particular, it is preferred that the scrubbing layer be no wider than that which can be grasped easily by the hand. The average wash cloth has a much greater dimension than the palm of the hand of the user. Though the wash clot in FIG. 2 is slightly rectangular, traditional square wash cloths can obviously be used. With the scrubbing layer so much smaller than the wash cloth, use of the soothing scrub, on the wash cloth side is not substantially different, e.g. less soft, or less water absorbent, from the usual wash cloth. In fact, it may make it easier to use the wash cloth. Though in FIG. 2 the scrubbing layer is centrally located, the central placement is not necessary. However, central placement does add the most to the ease of use of the wash cloth layer.

The soft soothing scrub of the present invention may be easily adapted to scrub the back of the user. To create a specially designed bath scrub, the wash cloth layer may be made of sufficient length to be easily wrapped around the back of the user, with the ends extending about the front of the body, to be comfortably grasped and moved back and forth to scrub the back. Alternatively, the soft soothing bath scrub of the present invention may be mounted on a strap or long narrow towel. The mounting may be temporary or permanent. A temporary attachment means, e.g., snaps, 20, may be added to correspond to snaps on a strap or long narrow towel may be used. The bath scrub may then be detached from the strap or long narrow towel for cleaning, or for use as a hand scrub.

The method of manufacture of the preferred embodiment of the scrubs of the present invention may be easily understood in relation to FIG. 3. As shown in FIG. 3, at manufacturing station (1), stabilizing layers 15, are provided to a conveyor belt 22. At station (2) adhesive material is placed in an intermittent pattern of the underside of the stabilizing layer. As shown, the adhesive is gravity feed , i.e. through a hopper, 24. At station (3), the scrubbing layer, 12 is placed atop the stabilizing layer, and heat and/or pressure are applied to secure the stabilizing layer to the scrubbing layer.

As shown in FIG. 3, wash cloth layers are provided in such a manner as to receive the top surface of the stabilizing layer. In this instance, the separate wash cloth layers are provided to an underlying conveyor belt, 23, and fed along the manufacturing line to receive the composite of the scrubbing and stabilizing layers. In another alternative process, only one conveyor belt may be used, with i.e. the wash cloth layer provided first, and the stabilizing layers provided not to another conveyor belt but to the wash cloth layer.

At station (5) any necessary trimming of the scrubbing layer and stabilizing layer may be performed, so that the stabilizing layer strictly underlies the scrubbing layer. At this station, moisture may also be added to the sponge, or other water expandable scrubbing layer, prior to fastening it to the wash cloth layer. At station (6) the scrubbing layer is fastened to the wash cloth layer. One preferred method of accomplishing this by stitching through the wash cloth and into the side edge, 17, of the scrubbing layer. Other intermittent fastening methods may be used, and there are many, but each must be chosen and controlled so as not to stiffen the overall scrub product, or provide any harshness on the surface of the scrubbing layer.

FIG. 3A illustrates the cross-section of a bath scrub according to the present invention, showing the attachment of the scrubbing layer to the wash cloth layer. The bath scrub, shown generally at 10, has a scrubbing layer, 12, attached to a wash cloth layer, 14, with a stabilizing layer, 15, therebetween. At the edges, 17, of the scrubbing layer, 12, stitches, 18, attach the edge of the scrubbing layer, to the wash cloth layer. FIG. 3A illustrates the configuration of the bath scrub when dry. As may be seen, the wash cloth layer comes up about the edges of the scrubbing layer, creating an uninterrupted, smooth washing surface.

FIG. 3B illustrates the bath scrub, 10*a*, of FIG. 3A, when wet, with the sponge of the scrubbing layer, 12*a*, expanded. As shown in FIG. 3B, the wash cloth layer is no longer pulled up to the top surface of the scrubbing layer, as the scrubbing layer has expanded to meet the wash cloth layer. As will be noted, however, the washing surface created is still an uninterrupted smooth surface.

Figure 4:
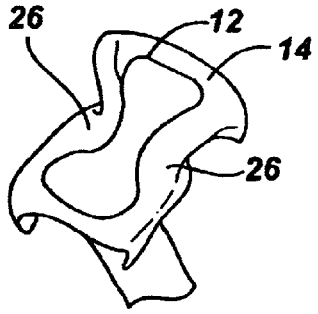
FIG. 4 is a perspective view of a preferred emodiment of the scrub of the present invention, grasped across the hourglass shape of the scrubbing layer.

FIG. 4 depicts the scrub of the preferred embodiment of the invention, when grasped by the user across the center portion or waist, of the hourglass sponge. With the wash cloth layer of the scrub grasped by the hand of the user, overfolds, 26, of the wash cloth, created by the thumb and finger tips, extend about the scrubbing layer at the center portion of the scrub. When used in this manner, it is easy to see that the wash cloth carries water about the scrubbing layer, reducing the need to rinse after scrubbing. When bathing in warm water, the folds and the entire wash cloth will provide warm water to warm the skin during scrubbing.

Figure 5:
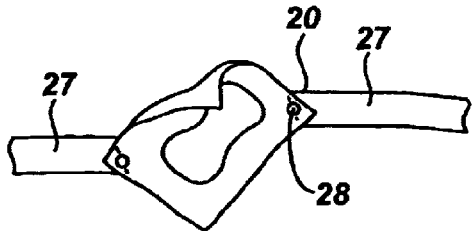
FIG. 5 is a top plan view of another preferred embodiment of the scrub of the present invention, elongated for use as an i.e. about the body back scrub.

As shown In FIG. 5, the scrub may be easily convened to use in hard to reach places, such as about the back of the user. This may be accomplished in any number of fashions. As shown in FIG. 5, releasable attachment means, such as button holes, 28, are provided near the edges of the scrub. As shown, they are provided in the corners of the wash cloth layer of the scrub. Buttons from the end of a single strap of the ends of two straps, 27, may be placed through to button holes, to create a releasable attachment. When the means for attachment are located at the corners of the wash cloth layer, the tilted profile of the hourglass scrubbing layer prevents the wash cloth from covering the scrubbing layer, to leave it exposed for use.

Figure 6:
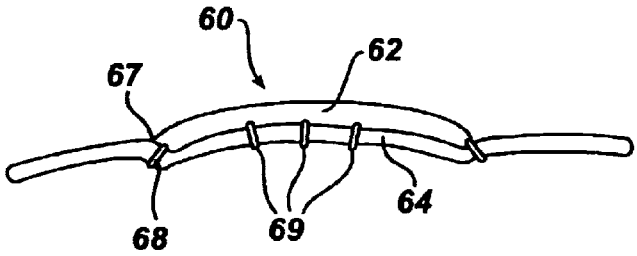
FIG. 6 is a cross-sectional view of another embodiment of the scrub of the present invention.

FIG. 6 illustrates another embodiment of the present invention, without a stabilizing layer. the scrub, shown generally at 60 has a scrubbing layer, 62, attached to a wash cloth layer, 64. Stitches, 68, attach the wash cloth layer to the edges, 67, of the scrubbing layer. If desired, stabilizing stitches, 69, may be used to attach the inner surface of the scrubbing layer to the wash cloth, as shown. Individual stitches, or loops are used.

Figure 6A:
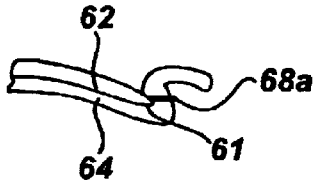
FIG. 6A is a cross-sectional view of the area of attachment of another embodiment of the invention.

As seen in FIG. 6A, if desired, the edges of the scrubbing layer may be shave down, or tapered. When the edges, 61, are tapered, it is preferred to stitch the wash cloth to the scrubbing layer as shown at 68*a* . This is accomplished by wrapping the wash cloth around the edge of the scrubbing layer, and across the upper surface at the edge of the scrubbing layer, and to stitching through the wash cloth layer, the edge, and the wash cloth layer.

We claim:

1. A soothing bath scrub comprising, a) a scrubbing layer, having an outer surface and an inner surface and a side edge therebetween, and, b) a wash cloth layer having a top surface larger than the outer surface of the scrubbing layer, and a bottom surface, the inner surface of the scrubbing layer attached to the top surface of the wash cloth layer by c) intermittent fastenings extending through the wash cloth layer and into the side edge of the scrubbing layer without passing through the outer surface of the scrubbing layer, thereby creating a soothing bath scrub having a smooth uninterrupted washing surface comprising a substantially non-water-retaining, skin abrasive scrubbing portion comprising the outer surface of the scrubbing layer, and a water absorbing and releasing wash cloth portion, comprising the portion of the top surface of the wash cloth layer which extends past the side edge of the scrubbing layer.

2. The soothing bath scrub of claim 1, further comprising, a stabilizing layer, attached to the inner surface of the scrubbing layer by a continuous layer of intermittent adhesive fastening areas.

3. The soothing bath scrub of claim 2 wherein the intermittent adhesive fastening areas comprise droplets of rubber sap.

4. The soothing bath scrub as in claim 2, wherein the material of the stabilizing layer is selected from the group consisting essentially of a foam layer, netting, or a napped fabric layer.

5. The soothing bath scrub of claim 1, wherein the profile of the scrubbing layer has an hourglass shape.

6. The soothing bath scrub of claim 1 wherein the scrubbing portion of the washing surface of the bath scrub is surrounded by the wash cloth portion of the washing surface.

7. The soothing bath scrub of claim 1, wherein the intermittent fastenings are stitches.

8. The soothing bath scrub of claim 1, wherein the wash cloth layer has a length approximating that of a bath towel.

9. The soothing bath scrub of claim 1, further comprising attachment means for attaching it to at least one strap, having the length of a bath towel.

10. The soothing scrub of claim 1, wherein the wash cloth layer extends about, and is stitched to, the outer surface of the scrubbing layer.

11. A soothing bath scrub comprising, a) a scrubbing layer, having an outer surface and an inner surface and a side edge therebetween, and, b) a wash cloth layer having a top surface larger than the outer surface of the scrubbing layer, and a bottom surface, the inner surface of the scrubbing layer attached to the top surface of the wash cloth layer by c) intermittent fastenings extending through the wash cloth layer and into the side edge of the scrubbing layer without extending across the outer surface of the scrubbing layer, thereby creating a soothing bath scrub having a smooth uninterrupted washing surface comprising a substantially non-water-retaining, skin abrasive scrubbing portion comprising the outer surface of the scrubbing layer, and a water absorbing and releasing wash cloth portion comprising the portion of the top surface of the wash cloth layer which extends past the side edge of the scrubbing layer.

12. A bath scrub comprising, a) a towel having a top surface, a bottom surface and a peripheral edge;

b) a scrubbing layer having a top surface, a bottom surface and a peripheral edge, said scrubbing layer is secured to the towel with intermittent stitches such that the bottom surface of the scrubbing layer faces the top surface of the towel, such that no stitches pass through the top surface of the scrubbing layer, the surface area of the top surface of the scrubbing layer being less than the surface area of the top surface of the towel, whereby the top surface of the towel includes a wiping portion surrounding the scrubbing layer so that the scrubbing layer and the exposed portion of the top surface of the towel can be used at the same time.

13. A bath scrub comprising, a) a towel having a top surface, a bottom surface and a peripheral edge;

b) a scrubbing layer having a top surface, a bottom surface and a peripheral edge, said scrubbing layer is secured to the towel with intermittent stitches such that the bottom surface of the scrubbing layer faces the top surface of the towel, such that no stitches extend across the top surface of the scrubbing layer, the surface area of the top surface of the scrubbing layer being less than the surface area of the top surface of the towel, whereby the top surface of the towel includes a wiping portion surrounding the scrubbing layer so that the scrubbing layer and the exposed portion of the top surface of the towel can be used at the same time.

* * * * *